United States Patent [19]

Gueret

[11] 4,437,477

[45] Mar. 20, 1984

[54] MAKE OF UNIT COMPRISING A CONTAINER AND AN APPLICATOR CLOSING THE CONTAINER

[75] Inventor: Jean-Louis H. Gueret, Paris, France

[73] Assignee: "L'Oreal", Paris, France

[21] Appl. No.: 377,172

[22] Filed: May 11, 1982

[30] Foreign Application Priority Data

Jun. 1, 1981 [FR] France ..... 81 10785

[51] Int. Cl.[3] ..... A45D 40/30

[52] U.S. Cl. ..... 132/88.5; 401/128

[58] Field of Search ..... 132/88.5, 88.7; 401/122–128, 130

[56] References Cited

U.S. PATENT DOCUMENTS

| | | | |
|---|---|---|---|
| 2,029,835 | 2/1936 | Reichle | 132/73 X |
| 3,756,731 | 9/1973 | Aubry | 401/122 |
| 3,921,650 | 11/1975 | Montgomery | 401/128 |
| 4,276,718 | 7/1981 | Keeton | 401/126 |

*Primary Examiner*—Gregory E. McNeill

*Attorney, Agent, or Firm*—Cushman, Darby & Cushman

[57] ABSTRACT

A make-up applicator has a container and an applicator which closes the container in a substantially leakproof manner and carries an applying member to draw up liquid make-up from the container and apply it to the surface to be made up.

The container neck terminates within the barrel of the container at a wiper lip around a non-circular opening and the make-up applying member is of similar non-circular section so rotation within the wiper lip is prevented. A movement permitting connection between the container cap (part of the applicator) and the applying member allows substantially leakproof sealing of the container by the applicator and secure fastening of the cap to the neck while still permitting the flat spatula end of the make-up applying member to co-operate with the wiper lip around the non-circular opening therewithin.

11 Claims, 6 Drawing Figures

MAKE OF UNIT COMPRISING A CONTAINER AND AN APPLICATOR CLOSING THE CONTAINER

DESCRIPTION

The present invention concerns a make-up unit comprising a container for a make-up product such as eyeshadow, a cheek blusher or any eye ring camouflager, and a detachable applicator carrying a make-up applying member allowing the make-up contained in the container to be drawn off, transported and spread on the skin surface.

A make-up unit of this kind has already been described in U.S. patent application Ser. No. 349,404. The detachable make-up applicator of this unit carries a cap screwed on to the threaded neck of the liquid make-up container. The make-up applying member of the applicator is formed by an elongate soft rubber spatula shape made of a soft, elastically deformable material; in the side of the spatula, are two cavities each constituting a reservoir wherein the liquid make-up is maintained by capillarity. The threaded neck of the liquid make-up container is extended internally by a flexible sleeve whose bottom end opening receives the make-up spatula. The spatula is provided with an annular rim which is pressed against the edge of the opening to ensure a leak proof closure when the applicator is screwed on to the container neck.

In this make-up unit, the edge of the withdrawal opening cannot form a wiper lip for the make-up spatula, that is to say a lip with a thin edge which could tightly grip the flat profile of the spatula and which would therefore have the configuration of a circle flattened into an ellipse, because the make-up spatula could then not rotate within the wiper lip in the screwing-up process. However, it is frequently desirable to provide make-up containers with a wiper lip for removing any excess product drawn off by the make-up applying member.

It is therefore an object of the present invention to provide a make-up unit whose make-up applying member, because it does not have a cylindrical profile based on a director circle, and could not turn within the wiper lip, nevertheless has its annular rim capable of being pressed against the wiper lip to ensure the tightness of the container in its closed position, either by screwing-up or by catch engagement of the applicator on the container neck.

Accordingly the present invention provides a make-up unit comprising a necked container for fluid make-up, and a detachable applicator passing through said neck and ending in a make-up applying member for drawing off the liquid make-up from the container, and for transporting it to and spreading it on the surface to be made up, wherein the make-up applying member is of non-circular cross-section and in the closed condition of the container received within a conforming non-circular withdrawal opening of the said container so as to stopper it in a substantially leakproof manner, wherein said withdrawal opening is bounded by a wiper lip gripping the make-up applying member and preventing it from turning within the wiper lip, wherein the applicator comprises two elements fitted one within the other and interconnected so that they are capable of relative motion with respect to one another, and wherein that one of the two interfitted elements which does not carry the make-up applying member is provided with means for releasably engaging the wall of the container neck.

It is preferable for the applicator or the make-up applying member thereof to have an annular sealing rim abutting the base of the wiper lip as the container is being closed.

The make-up container advantageously contains a liquid make-up, in particular eye shadow, a cheek blusher or an eye-ring camouflager.

In a first variant of the invention, the two elements of the applicator can have a relative rotational motion and that one of these two elements which does not carry the make-up applying member preferably comprises screwing devices allowing it to be fixed on the threaded neck of the container. In view of this, as the container is being closed, the other element carrying the make-up applying member can be inserted inside the container without being caused to rotate by the top element, and the annular sealing rim may thus be pressed against the wiper lip.

In this variant, it is preferable for the screwing device of the one said fitted element to be a screw cap engaging threads on the neck of the container. The cylindrical articulation may be formed by means of, on the one hand, a peripheral groove in the associated one of the two elements and, on the other hand, a continuous or discontinuous retaining bead arranged on the other element, which retaining ring engages within the above mentioned peripheral groove.

To prevent the one applicator element which carries the make-up applying member from being caused to rotate by the other element as the container is being closed, the said one element has a non-circular cross-section preventing it from turning within the neck of the container.

In a second preferred variant of the invention, the two elements of the applicator may be capable of relative translational motion and the top applicator element which does not carry the make-up applying member is catch-fitted within the container neck. An elastic member is inserted between the two interfitted elements so that when the top element is catch-engaged with the neck the said elastic member is compressed and allows the necessary elastic tightening for a good seal of the annular rim against the wiper lip.

Advantageously the active part of the make-up applying member is a flat, elongate spatula. The spatula is traversed from side to side by at least one cavity constituting a reservoir wherein the liquid make-up is kept by capillarity. The make-up applying member is made of a soft, elastically deformable material, for instance of natural or synthetic rubber.

The elastic member may be a plastic foam plug inserted between the two applicator elements within that of the two fitted elements which accommodates the other, that is to say, preferably the element which does not carry the make-up device.

Advantageously, the catch fitting of the top element in the neck is achieved by catch engagement means, integrally moulded with the said top element, the said catch engagement means being pushed radially outwardly by the elastic member into an opening in the side wall of the container neck. The said applicator element which carries the make-up applying member advantageously has a non-circular cross-section preventing it from turning within the neck of the container.

The wiper lip of the make-up device, in either variant, is preferably formed by the bottom end opening of a sleeve arranged within the container barrel as an extension of the container neck.

In order that the present invention may more readily be understood, there will now be described below merely by way of example two embodiments shown in the accompanying drawings in which.

Figure 1:
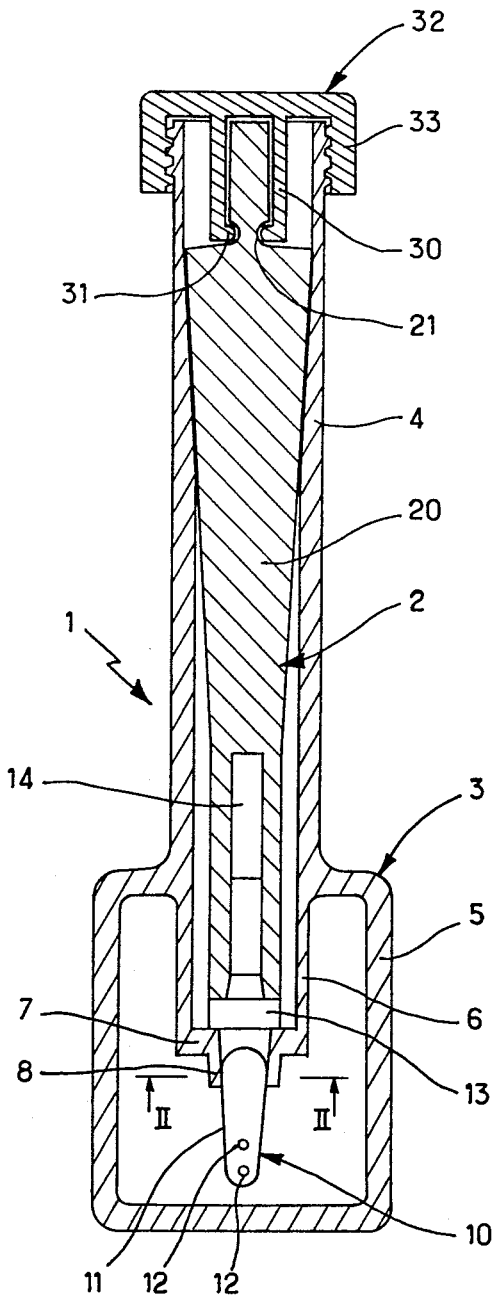
FIG. 1 is an axial cross section of a first type of make-up unit according to the invention.

Referring now to the drawings, there will be seen a first type of eyelid make-up unit generally designated 1.

The make-up unit 1 derives from the association of an applicator 2 with a container 3 containing liquid eye shadow. The threaded neck 4 and the barrel 5 of the container have an oval cross section, arranged such that the plane of section of FIG. 1 passes through the major axis of the said oval. The threaded neck 4 is extended within barrel 5 of the container by a sleeve 6 having its bottom end opening 7 serving as a withdrawal opening for the make-up applying member 10 comprising a spatula 11.

The applicator 2 carries the make-up applying member 10 for drawing off the liquid make-up from the barrel 3 of the container, transporting it, and then spreading it on the eyelids. The make-up device 10 is obtained by moulding; it is made of soft natural or synthetic rubber. The active part of the make-up applying member 10 consists of the spatula 11 of flat, elongate shape. Two circular cavities 12 near the rounded free end of the spatula 11 pass through it from side to side. Each cavity 12 is dimensioned in such a way that once it is charged with liquid make-up, the liquid drawn off should be maintained within the cavity by capillarity during the transit of the spatula from container 3 to the eyelids to be made up, the liquid then being applied to the eyelids by a slight pressure exerted on the spatula 11. A make-up applying member 10 of this kind has been described in detail in the above-mentioned U.S. patent application Ser. No. 349,404.

Figure 2:
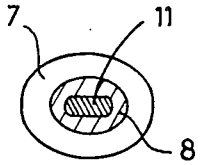
FIG. 2 is a transverse cross section along the line II—II of FIG. 1.
Figure 5:
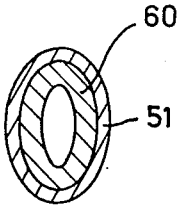
FIG. 5 is a transverse cross section along the line V—V of FIG. 4.
Figure 6:
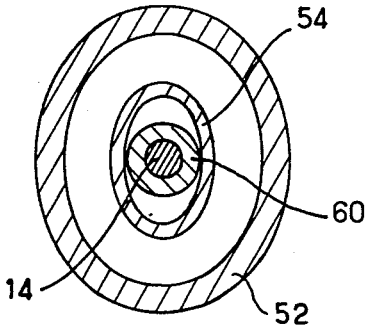
FIG. 6 is a transverse cross section along the line VI—VI of FIG. 4.
Figure 3:
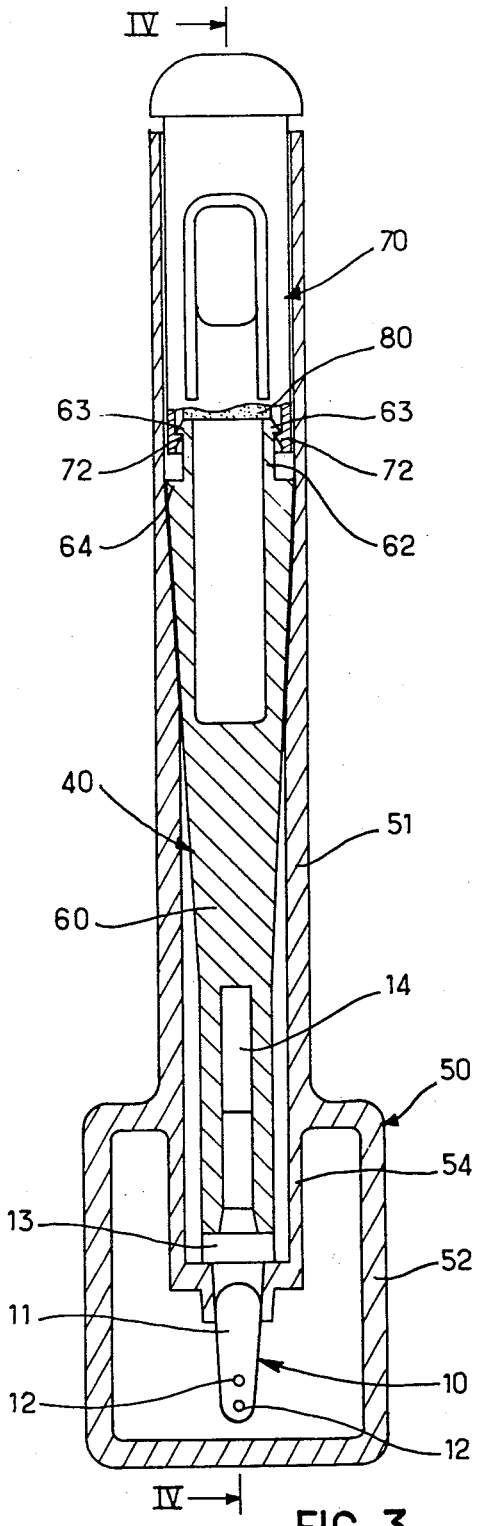
FIG. 3 is an axial cross section, taken along the line III—III of FIG. 4, of a second type of make-up unit according to the invention.
Figure 4:
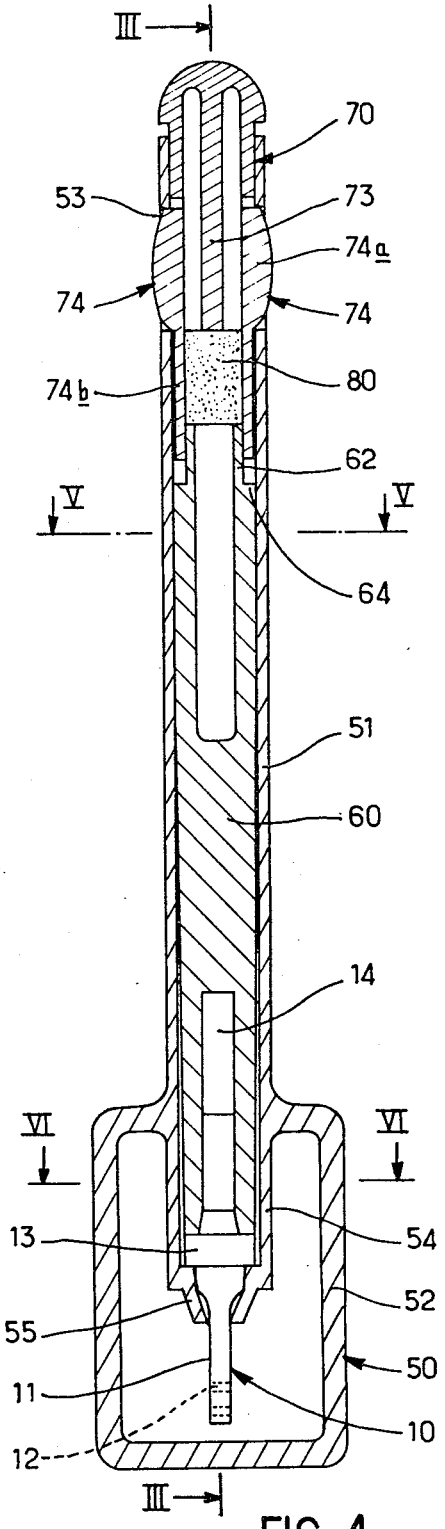
FIG. 4 is an axial cross section along the line IV—IV of FIG. 3.

During making up, when the applicator 2 is withdrawn from container 3, the peripheral lip 8 around the withdrawal opening of the sleeve 6 exerts a wiping action, that is to say it removes the excess liquid make-up drawn off by the spatula 11. The wiper lip 8 closely fits the side of spatula 11 when the container 3 is closed; as may be seen in FIG. 2 of the drawing, the cross section of wiper lip 8 has the shape of a circle flattened into an ellipse, which prevents any rotation of the spatula 11 within the wiper lip 8.

An annular rim 13 integral with the spatula 11 engages the wiper lip 8 when the container 3 is closed, to ensure the leakproof stoppering of the withdrawal opening delimited by the wiper lip.

The make-up applicator 2 is formed by two substantially coaxial elements 20, 30 fitted together, interconnected by a cylindrical articulation allowing them relative rotation around their common axis. Element 20 is a rod, having captive in one of its ends the tail 14 of the make-up applying member 10. The other end of rod 20 is fitted within the hollow sleeve element 30 of the cap 32 serving to close the container. The cylindrical articulation connecting the two elements 20 and 30 is formed on the one hand by a peripheral groove 21 in rod 20 and on the other hand, by a retaining bead 31 in relief on the radially inner surface of the hollow element 30 and which cooperates with the peripheral groove 21.

The cross section of rod 20 has an oval shape so that rod 20 cannot turn within the also oval threaded neck 4. On the other hand, the hollow element 30 has a cylindrical shape and can therefore swivel around its longitudinal axis within the threaded neck 4.

The hollow element 30 is surmounted by the integral cap 32 whose skirt 33 carries an internal thread intended to cooperate with the outer thread of the container neck 4.

The container 3 is stoppered by means of the applicator 2 which has just been described, and this is effected by suitably orientating the applicator 2, inserting it inside the threaded neck 4 so that spatula 11 enters the end opening delimited by the wiper lip 8, and continuing this motion until the annular rim 13 of the make-up applying member 10 abuts the wiper lip 8. When cap 32 is then tightly screwed on the threaded neck 4 of the container, the hollow element 30 and hence of rod 20 are lowered and the rim 13 becomes squashed against the edge of wiper lip 8; as a result, leakproof closure of the container 3 is achieved. During the screwing-up operation, the rotational movement imparted to the hollow element 30 is not transmitted to rod 20 since the inner retaining bead 31 of element 30 slidably turns the peripheral groove 21 and since rod 20 held stationary because of its oval profile is unable to turn within the threaded neck 4.

Referring now to FIGS. 3 to 6 of the drawings, there will be seen a second type of a make-up unit according to the invention.

This make-up unit also derives from the association of an applicator 40, which bears a make-up applying member 10 in all respects analogous to that of FIG. 1, with a liquid make-up container 50 whose neck 51 and barrel 52 have an oval shape. Near its top end the neck 51 has two diametrically opposite rectangular openings 53, in the side wall. Neck 51 is continued within the barrel 52 of the liquid make-up container by an oval cross section sleeve 54 whose bottom end opening is intended to be closed in a leakproof manner by the make-up applying member 10. The above mentioned opening, which is of oval cross section, is bounded by a wiper lip 55 which tightly grips the spatula 11 of the make-up applying member 10.

The detachable applicator 40 is formed by two substantially coaxial connected elements 60, 70 which are assembled together in such a way that the one is capable of a limited translational motion relative to the other, along their common axis. The tail 14 of the make-up applying member 10 is captive in one of the ends of element 60 of the applicator. Element 60 is a rod comprising two sections of different profiles, the one cylindrical and the other oval, the cylindrical section being disposed at the end nearer the make-up applying member 10. The oval part has a cross section which increases towards the end of element 60 which is further from the make-up applying member 10. By reason of its oval cross-section, the element 60 of the applicator cannot turn within the neck 51 of the container. At its end furthest from the make up applying member 10, the element 60 of the applicator terminates in a constriction 62 which also has an oval cross-section. Two stops 63, provided in relief at the upper end of constriction 62, are disposed on the ends of the major axis of the oval profile of the constriction 62.

The element 60 of the applicator has its constriction 62 fitted within the hollow element 70 which also has an oval cross section. The hollow element 70 comprises two opposite internal teeth 72 disposed along the major axis of the oval. The hollow element 70 can slide axially on constriction 62, without the possibility of any rotation relative thereto, from a position where it substantially abuts the annular shoulder 64 (FIG. 3) to another position where the two teeth 72 of the hollow element 70 engage the two stops 63 of element 60.

A plastic foam plug 80, inserted within the hollow element 70, forms a spring abutting, on the one hand, the adjacent end of the constriction 62 of the element 60 and, on the other hand, an inner pin 73 (FIG. 4) integral with the hollow element 70.

Two outward catches 74, arranged on the side wall of the hollow element 70, serve to hold the element 50 in place in the top of neck 51. They are formed integrally with the hollow element 70 and each comprises a protruberance **74*a* connected via a thin plate 74*b* to the side of the hollow element 70; the plane of symmetry of the two catches 74 includes the minor axis of the oval profile of the hollow element 70. The plastic foam plug 80 is inserted between the two thin plates 74*b* of the two catches 74**, which thus have the tendency to move apart from each other under the action of the spring plug.

The closure of the liquid eyeshadow container 50, by means of applicator 40, is effected as follows: Once suitably orientated, the applicator 40 is inserted in the neck 51 of the container so that the spatula 11 of the make-up applying member closes the opening bounded by the wiper lip 55. In the course of this insertion, the two catches 74 are squeezed together to compress the plastic foam plug 80 which makes it possible to cause the catches to enter the neck 51; this action is continued until, under the effect of the compressed foam plug 80, the protruberances **74*a* are aligned with the two rectangular openings 53 of the container neck and are released to become accommodated in the two rectangular openings 53. The applicator 40 is then fixed within the container. In this position, the plastic foam plug 80 is axially compressed between the two elements 60 and 70 of the applicator 40, and hence the annular rim 13 of the make-up applying member 10 is elastically pressed against the wiper lip 55**. The liquid make-up container is thus hermetically closed.

To withdraw the applicator 40 from the container, the user squeezes the two protruberances **74*a* of the two catches together against the action exerted by spring 80, causing them to release from the apertures 53 and to penetrate the upper end of the neck of the container. Pulling the applicator 40** upwards allows it to be withdrawn without difficulty from the liquid make-up container.

It will be observed that, in this second type of make-up unit, the plastic foam plug 80 has a double function. On the one hand, it tends to push the two catches 74 towards their catch engagement position inside of the two rectangular openings 53 of the container neck; on the other hand, as the container is being closed the spring plug elastically presses the annular rim 13 of the make-up device against the wiper lip 55 to ensure the required seal. Leakproof closure of the liquid make-up container is in this case achieved by means of the make-up applying member 10 without causing the member 10 to turn within the wiper lip 55.

It shall be duly understood that the two embodiments described above are in no way restrictive and may give rise to any desirable modification without thereby departing from the scope of the invention as defined by the following claims.

I claim:

1. In a make-up unit comprising:

(a) container means for liquid make-up;

(b) a neck to said container means;

(c) means defining a withdrawal opening of said container means;

(d) detachable applicator means adapted to enter said neck;

(e) make-up applying means adapted to draw off liquid make-up from said container means, to transport it, and to spread it on a surface to be made up, said make-up applying means including means stoppering said withdrawal opening of the said container means in a substantially leakproof manner when the container is closed by means of the applicator means; and (f) wiper lip means bounding said withdrawal opening and arranged to grip the make-up applying means, the said make-up applying means and said withdrawal opening each having a non-circular cross section which prevents rotation of said make-up applying means relative to said wiper lip means when gripped thereby, the improvement wherein said applicator means comprises;

(g) first and second elements fitted one within the other;

(h) means interconnecting said first and second elements so that one thereof is capable of relative motion with respect to the other, said first element carrying said make-up applying means; and (i) means on said second element for releasably engaging said neck of the container.

2. A make-up unit according to claim 1, wherein said wiper lip means has a proximal end and a distal end and said substantially leakproof stoppering means of the applicator means includes an annular sealing rim positioned to abut the proximal end of the wiper lip means upon closing of the container means by said applicator means.

3. A make-up unit according to claim 1, wherein the make-up applying member includes a flat elongate spatula made of a soft, elastically deformable material.

4. A make-up unit according to claim 3, including cavity means traversing the spatula from side to side thereof, said cavity means constituting a reservoir wherein a said liquid make-up is held by capillarity.

5. A make-up unit according to any one of claims 1 to 4, wherein said container means includes a barrel, and sleeve means coaxial with the container wiper lip means and extending downwardly into the barrel, and wherein said wiper lip means comprises the bottom end opening of said sleeve means within the barrel of the make-up container means.

6. A make-up unit according to any one of claims 1 to 4, wherein said means interconnecting said first and second elements of the applicator means comprises a cylindrical articulation, allowing them a relative rotational motion around their common axis.

7. A make-up unit according to claim 6, wherein said means on the second element for releasably engaging the neck of the container means comprises a threaded cap which is screwed on the neck of the container.

8. A make-up unit according to any one of claims 1 to 4, wherein said means interconnecting said first and second elements of the applicator means allow translational movement of said first element relative to said second element along an axis common to them both, said means of the second element relatively engaging the neck comprising catch engagement means cooperating with the neck of the container means.

9. A make-up unit according to claim 8, and including elastic means inserted between said first and second elements of the applicator means, said elastic means being effective to press said annular sealing rim elastically against the wiper lip means as the container means is being closed.

10. A make-up unit according to claim 9, wherein said neck includes recess means to receive said catch engagement means when the container means is closed, said catch engagement means is integrally moulded with the said second element, and said elastic means is effective to bias said engagement means outwardly into engagement with said recess means.

11. A make-up unit according to any one of claims 1 to 4, wherein said first element has a non-circular cross-section preventing it from turning within the neck of the container means.

* * * * *